US008301060B2

(12) United States Patent
Mori

(10) Patent No.: US 8,301,060 B2
(45) Date of Patent: Oct. 30, 2012

(54) IMAGE FORMING APPARATUS WITH A BELT UNIT AND A MARK SENSOR

(75) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 497 days.

(21) Appl. No.: 12/410,876

(22) Filed: Mar. 25, 2009

(65) Prior Publication Data

US 2009/0245860 A1 Oct. 1, 2009

(30) Foreign Application Priority Data

Mar. 26, 2008 (JP) ..... 2008-080627

(51) Int. Cl.
*G03G 15/08* (2006.01)

(52) U.S. Cl. ..... 399/121

(58) Field of Classification Search ..... 399/110, 399/121, 303, 308

See application file for complete search history.

(56) References Cited

U.S. PATENT DOCUMENTS

| | | | | |
|---|---|---|---|---|
| 6,522,848 | B2 * | 2/2003 | Wakana | 399/121 |
| 7,369,793 | B2 * | 5/2008 | Kumazawa | 399/121 |
| 7,454,158 | B2 * | 11/2008 | Nakano et al. | 399/121 |
| 7,587,157 | B2 * | 9/2009 | Matsuda et al. | 399/301 |
| 7,623,809 | B2 * | 11/2009 | Nakano et al. | 399/121 |
| 7,711,299 | B2 * | 5/2010 | Furukawa et al. | 399/303 |
| 7,848,663 | B2 * | 12/2010 | Okano | 399/13 |
| 7,865,113 | B2 * | 1/2011 | Nakashima | 399/121 |
| 7,957,672 | B2 * | 6/2011 | Kato et al. | 399/121 |
| 2007/0160396 | A1 | 7/2007 | Adachi et al. | |

FOREIGN PATENT DOCUMENTS

| | | | |
|---|---|---|---|
| JP | 05-142906 | A | 6/1993 |
| JP | 06-035288 | A | 2/1994 |
| JP | 11-065397 | A | 3/1999 |
| JP | 11-237773 | A | 8/1999 |
| JP | 2000-275987 | | 10/2000 |
| JP | 2001-034028 | A | 2/2001 |
| JP | 2001-194853 | A | 7/2001 |
| JP | 2002-031927 | A | 1/2002 |
| JP | 2003-280407 | | 10/2003 |
| JP | 2004-029525 | A | 1/2004 |
| JP | 2004-125827 | | 4/2004 |
| JP | 2006-220943 | A | 8/2006 |
| JP | 2007-187700 | A | 7/2007 |

OTHER PUBLICATIONS

Notice of Reasons for Rejection for corresponding Japanese Patent Application No. 2008-080627 mailed Jul. 13, 2010.
Office Action mailed Mar. 15, 2010, for counterpart Japanese Application 2008-080627.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

An image forming apparatus with a detachable belt unit and supporting frame are described. The detachable belt unit is positioned in the supporting frame. One or more mark sensors are positioned on the supporting frame and are configured to detect alignment marks deposited on an endless belt of the belt unit.

10 Claims, 6 Drawing Sheets

IMAGE FORMING APPARATUS WITH A BELT UNIT AND A MARK SENSOR

CROSS-REFERENCE TO RELATED APPLICATION

This application claims priority from Japanese Patent Application No. 2008-080627, filed on Mar. 26, 2008, the entire subject matter of which is incorporated herein by reference.

FIELD

Aspects of the invention relate to an image forming apparatus configured to form an image using a plurality of colors of developers, more specifically to an image forming apparatus including an endless belt detachably attached to an apparatus body and being configured to form the image using the endless belt.

BACKGROUND

It is well known that an image forming apparatus may include an image formation unit, which may form an image by transferring a plurality of colors of developers, e.g., color toners, and an endless belt, which may be rotatably disposed opposite to the image formation unit. In the image forming apparatus, it has been proposed that the image is formed on a recording medium transported by the endless belt. Alternatively, it has been also proposed that the image may be formed on a recording medium by transferring the developers once onto the endless belt and then transferred from the endless belt onto a recording medium.

It has been proposed that, in the image forming apparatus, color shifts are corrected by detecting registration marks, which the image formation device forms on the endless belt, based on irradiated light reflected from the endless belt. In this case, it is necessary to place a mark sensor that detects the registration marks based on the reflected light in position with respect to the endless belt. As a measure, rollers for extending the endless belt therebetween and registration mark sensors are disposed on a side plate for fixing components thereto.

SUMMARY

However, the endless belt of the above image forming apparatus is fixed to the apparatus body, and thus cannot be replaced alone. If wear or damage occurs in the fixed endless belt, the image forming apparatus needs to be sent to the factory for repair. To enable replacement of the endless belt as a belt unit, a positioning member for the belt unit needs to be disposed on the side plate such that the belt unit is placed in position with respect to the positioning member. In this case, errors in the installation positions of components installed to the side plate, such as the positioning member and a registration mark detecting sensor, may accumulate and adversely affect the positional accuracy between the registration mark detecting sensor and the endless belt, and make it difficult to correct color shifts.

One or more aspects of the invention provide an image forming apparatus including a detachable belt unit having an endless belt and being configured to correct color shifts by detecting a registration mark formed on the endless belt, wherein the endless belt and a mark sensor that detects the registration mark are positioned accurately.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings.

It is noted that various connections are set forth between elements in the following description. It is noted that these connections in general and, unless specified otherwise, may be direct or indirect and that this specification is not intended to be limiting in this respect.

Figure 1:
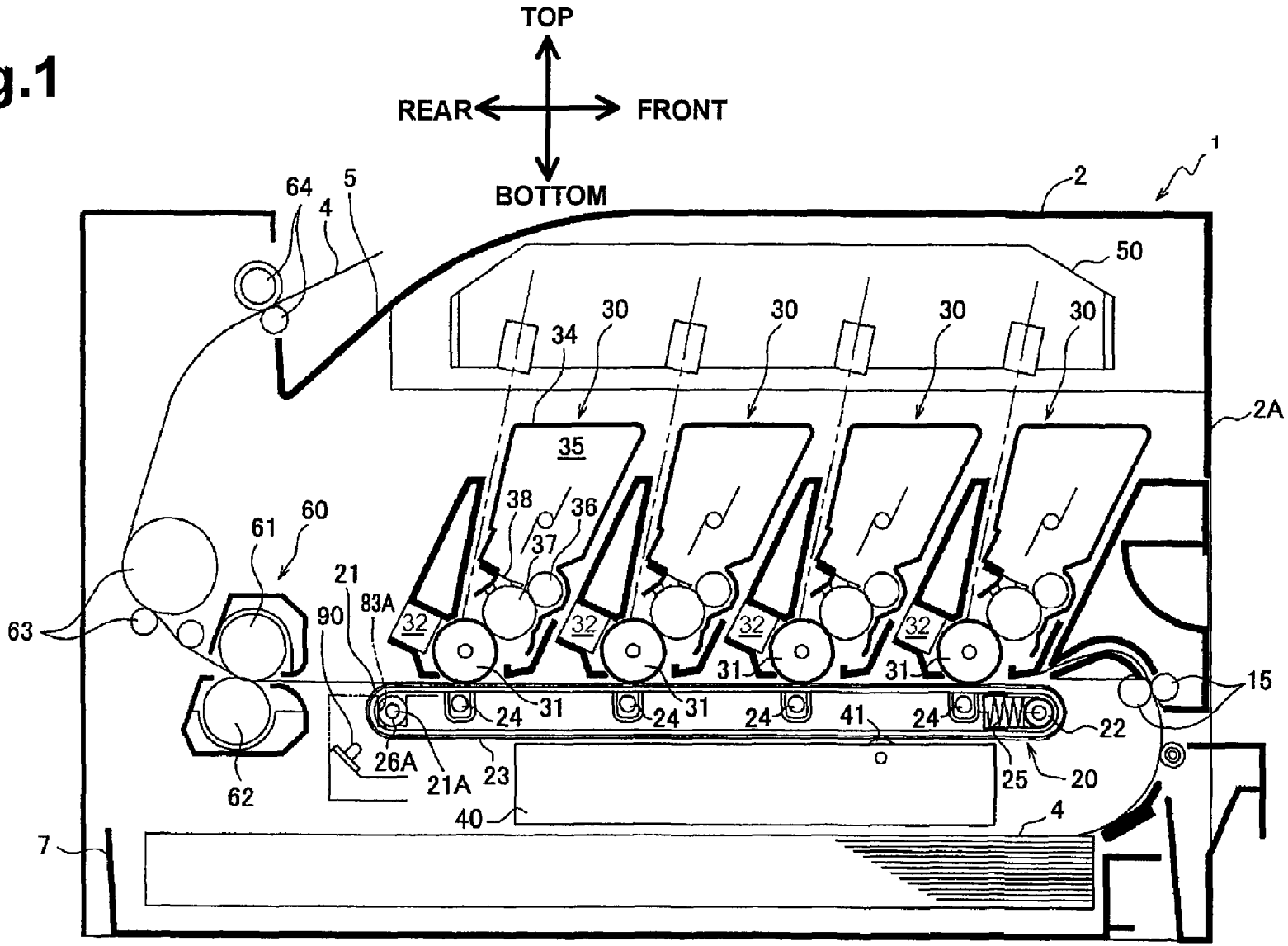
FIG. 1 is a side sectional view of an internal structure of an illustrative example of an image forming apparatus using features described herein.

For ease of discussion, in the following description, the top or upper side, the bottom or lower side, the left or left side, the right or right side, the front or front side, and the rear or rear side are used to define the various parts when an image forming apparatus 1 is disposed in an orientation in which it is intended to be used. In FIG. 1, the right side is referred to as the front or front side, the left side is referred to as the rear or the rear side, the up side is referred to as the top or upper side, and the down side is referred to as the bottom or lower side.

In addition, in the following description, an apparatus body refers to an image forming apparatus 1 exclusive a sheet supply tray 7, related parts attached to the sheet supply tray 7, and a belt unit 20.

As shown in FIG. 1, the image forming apparatus 1 is a color laser printer of direct transfer tandem type, and may include a generally box-shaped main body 2. A top surface of the main body 2 contains an output tray 5 on which a recording sheet 4 having an image thereon is placed. A front cover 2A covers the front side of the main body 2 and is configured to pivot on a front lower end of the image forming apparatus 1. With the front cover 2A open, a belt unit 20 and image formation units 30 may be pulled to the front from inside of the main body 2.

A sheet supply cassette 7 may be disposed in a lower portion of the main body 2 and configured to load a stack of sheets 4 therein. The sheet supply cassette 7 may be configured to be attached to and removed from the front of the main body 2. A sheet 4 stored in the sheet supply tray 7 is singly picked up by a known pickup roller (not shown) and conveyed to registration rollers 15. The registration rollers 15 feed the sheet 4 at timing to a belt unit 20.

The belt unit 20 is configured to be attached to and removed from the main body 2 and includes a drive roller 21, a tension roller 22, and a conveyor belt 23. The drive roller 21 and the tension roller 22 are spaced apart in the front-rear direction in parallel to each other at their rotation shafts. The tension roller 22 is urged toward the front by a spring 25 to apply an appropriate tension to the conveyor belt 23. Thus, the conveyor belt 23 is horizontally extended between and looped around the drive roller 21 and the tension roller 22. The conveyor belt 23 is an endless semiconducting belt (transfer belt) made of a resin such as polycarbonate. When the drive roller 21 disposed at the rear is driven and rotated by a main motor (not shown), the conveyor belt 23 rotates counterclockwise in FIG. 1 to convey the sheet 4 thereon rearward.

Inside the conveyor belt 23, four transfer rollers 24 are spaced apart at regular intervals in the front-rear direction. The transfer rollers 24 are disposed facing respective photosensitive drums 31 of the image formation units 30 via the conveyor belt 23. In other words, the conveyor belt 23 is sandwiched between the transfer rollers 24 and the corresponding photosensitive drums 31. During image transfer, a bias is applied between the transfer roller 24 and the corresponding photosensitive drum 31 to pass a current therebetween. A known belt cleaner 40 is disposed under the belt unit 20. The belt cleaner 40 includes a cleaning roller 41 and is configured to remove waste, such as toner and dust from the conveyor belt 23.

Four image forming units 30 are arranged above the belt unit 20 in an order of black, yellow, magenta, and cyan, from an upstream side with respect to a direction where a sheet 4 is conveyed (hereinafter referred to as a sheet feed direction) or from the front side of the image forming apparatus 1. A scanner unit 50 is disposed above the image forming units 30. The scanner unit 50 includes a polygon mirror (not shown), and is configured to scan and expose each photosensitive drum 31 to laser light. The image forming units 30, the scanner unit 50 and transfer rollers 24 serve as an image formation device.

Each image forming unit 30 includes a photosensitive drum 31, a scorotron charger 32, and a developing cartridge 34. The photosensitive drum 31 includes a grounded metal drum body and a positively chargeable photosensitive layer (formed of polycarbonate) coating the drum body. The scorotron charger 32 is disposed diagonally above and away from the corresponding photosensitive drum 31 so as to face it. The scorotron charger 32 is configured to generate a corona discharge from a charging wire (made of, such as, tungsten) and cause the surface of the photosensitive drum 31 to become uniformly positively charged.

The developing cartridge 34 is generally box-shaped, and includes a toner chamber 35 in an upper portion inside and a supply roller 36, a developing roller 37 and a layer-thickness regulating blade 38 under the toner chamber 35. Each toner chamber 35 accommodates a developer, e.g. nonmagnetic one-component toner (which is to be positively charged) of black, cyan, magenta, or yellow.

Toner discharged from the toner chamber 35 is supplied to the developing roller 37 along with rotation of the supply roller 36, and positively charged between the supply roller 36 and the developing roller 37 by friction. The toner supplied onto the developing roller 37 goes in between the layer-thickness regulating blade 38 and the developing roller 37 along with the rotation of the developing roller 37, is sufficiently charged by friction therebetween, and carried on the developing roller 37 as a thin layer having a constant thickness.

The surface of the photosensitive drum 31 may be uniformly and positively charged by the scorotron charger 32, and exposed to the laser light emitted from the scanner unit 50 by high-speed scanning, and an electrostatic latent image is formed based on the image to be formed on the sheet 4.

When the developing roller 37 rotates, positively charged toner carried on the developing roller 37 is supplied to the electrostatic latent image formed on the surface of the photosensitive drum 31. Thus, the latent image on the photosensitive drum 31 becomes visible, and a toner image, in which toner is adhered to an exposed area only is carried on the photosensitive drum 31.

While the sheet 4 that is conveyed by the conveyor belt 23 passes between each photosensitive drum 31 and its corresponding transfer roller 24, the toner image carried on the surface of each photosensitive drum 31 is successively transferred onto the sheet 4 by the current. The sheet 4 to which four-color toner images have been transferred in this manner is conveyed to a fixing unit 60.

The fixing unit 60 is disposed at the rear of the conveyor belt 23 in the main body 2. The fixing unit 60 includes a heat roller 61 having a heat source (such as a halogen lamp) and a pressure roller 62 disposed facing the heat roller 44 so as to press the heat roller 61 from below and configured to be rotated along with the rotation of the heat roller 61. In the fixing unit 60, the sheet 4 having the four-color toner images thereon is heated while it is conveyed between the heat roller 61 and the pressure roller 62 and the toner images are thermally fixed onto the sheet 4. The sheet 4 on which the toner images have been thermally fixed is sandwiched between ejection rollers 63, which are disposed diagonally above the fixing unit 60, and conveyed therebetween. The sheet 4 is further conveyed between ejection rollers 64 disposed in the upper portion of the main body 2, and is finally ejected to the output tray 5.

Figure 2:
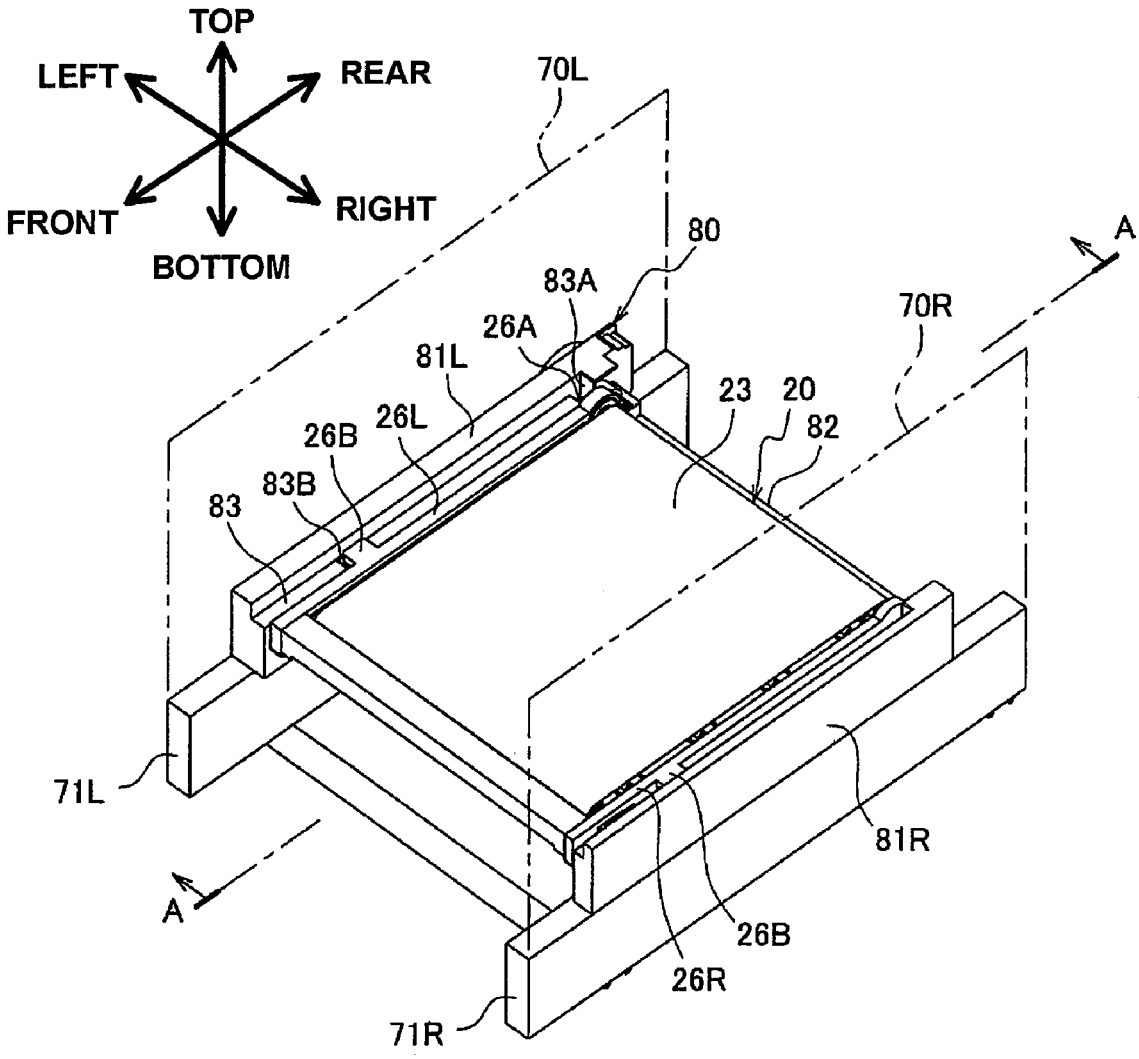
FIG. 2 is a perspective view of a support structure of a belt unit of the image forming apparatus.

A support structure of the belt unit 20 will be described. As shown in FIG. 2, a pair of frames 70L, 70R are disposed on the left and right inside the main body 2. The frames 70L, 70R are identical in shape and size and formed of metal plate by press working. Tray support portions 71L, 71R are disposed at the lower ends of the frames 70L, 70R. The tray support portions 71L, 71R are made of resin and configured to support the sheet supply tray 7. A belt unit supporting member 80 is disposed on upper ends of the tray support portions 71L, 71R. The belt unit supporting member 80 is configured to support the belt unit 20 in a detachable manner. Although it is not shown, the scanner unit 50 is fixed to upper ends of the frames 70L, 70R.

Figure 3:
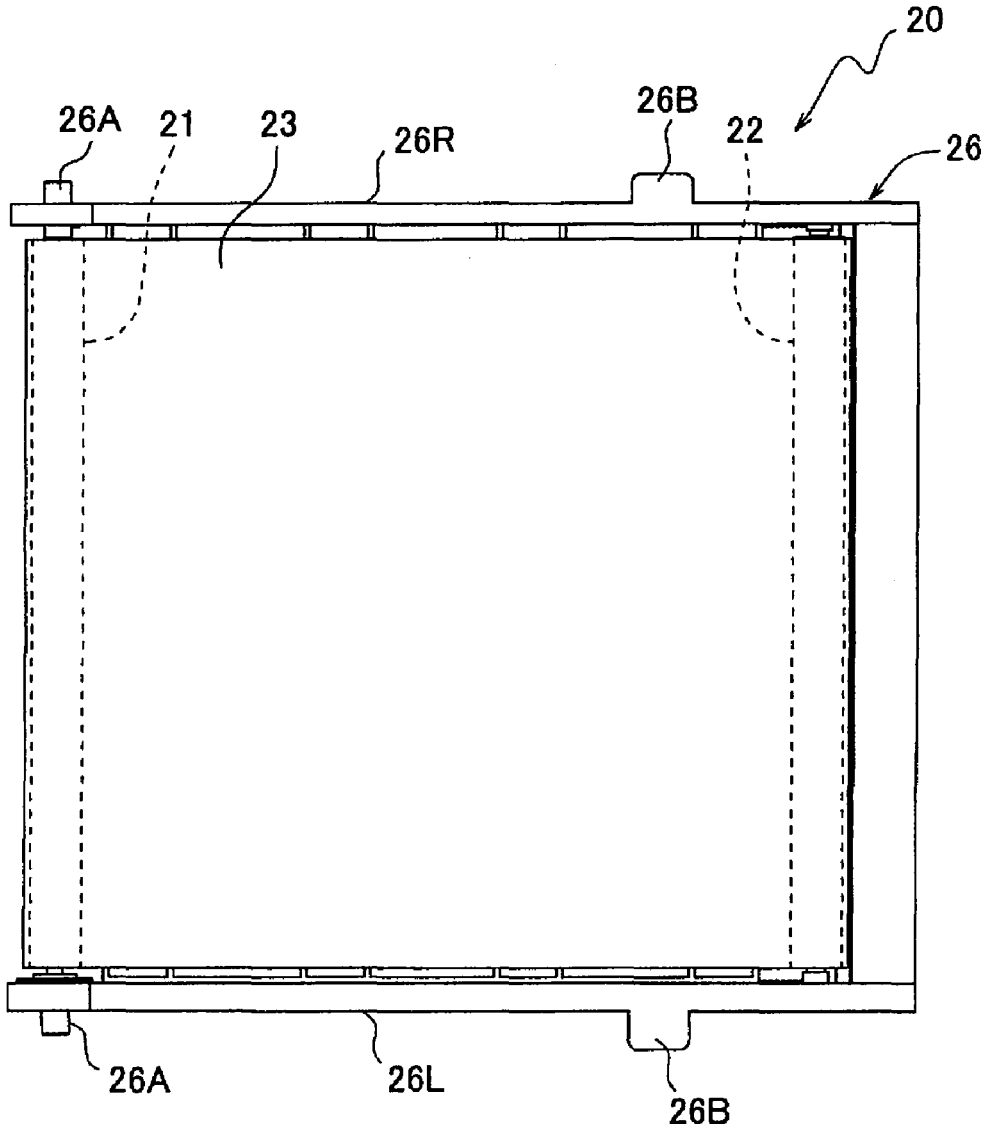
FIG. 3 shows a plan view and left side view of the belt unit.
Figure 3:
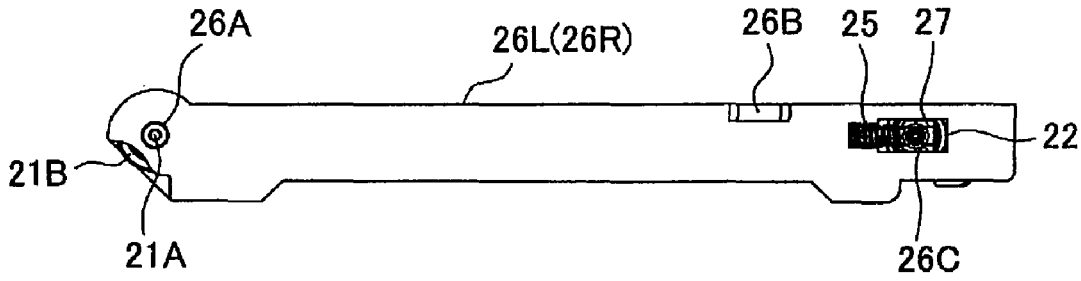

As shown in FIG. 3, the belt unit 20 includes a belt frame 26 that is configured to rotatably support the drive roller 21 and the tension roller 22 around which the conveyor belt 23 is extended. The belt frame 26 includes a pair of side portions 26L, 26R on the left and right sides. The side portions 26L, 26R are connected to each other at their front sides where the tension roller 22 is disposed and at their lower sides (see FIG. 5). Cylindrical-shaped bearing members 26A, which are configured to receive a rotation shaft 21A of the drive roller 21, protrude outward from each side portion 26L, 26R at the rear side thereof. Flat tab portions 26B protrude outward from the upper end of each side portion 26L, 26R at the front side (toward the drive roller 22) and are flush with the top surface of the conveyor belt 23.

Each side portion 26L, 26R is formed with a bearing hole 26C that is long in the front-rear direction. A bearing member 27 of the tension roller 22 is received in the bearing hole 26C. The spring 25 is inserted under compression between the rear end surface defining the bearing hole 26C and the bearing member 27. A gear 21B is partially exposed from lower rear end of the left side portion 26L. The gear 21B is configured to rotate integrally with the drive roller 21.

Figure 4:
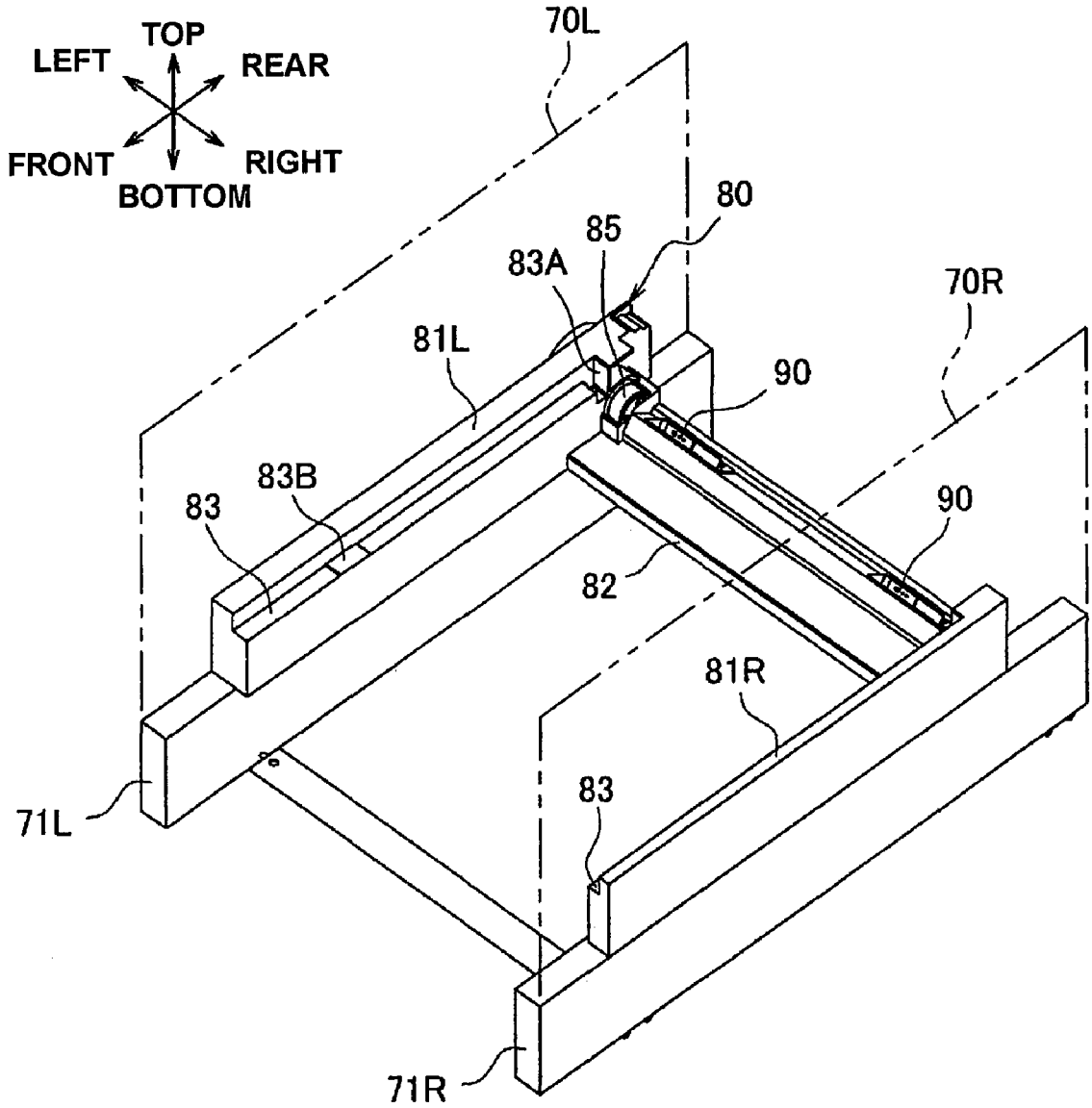
FIG. 4 is a perspective view of the support structure from which the belt unit is removed in FIG. 2.

As shown in FIG. 4, the belt unit supporting member 80 is made of resin and includes side portions 81L, 81R, which are an example of a positioning portion, and a connecting portion 82, which is an example of a holding portion for a mark sensor. The side portion 81L is disposed on the tray support portion 71L, and the side portion 81R is disposed on the tray support portion 71R. The connecting portion 82 extends between the side portions 81L, 81R to connect them. The belt unit supporting member 80 has a U-shaped configuration, as a whole, in plan view.

Each side portion 81L, 81R is formed with a recessed portion 83 on its inner surface. The recessed portions 83 are L-shaped such that they are flush with the side portions 26L, 26R of the belt unit 20 respectively. Each recessed portion 83 is formed with a groove 83A in which a corresponding one of the bearing members 26A is supported and a seat portion 83B in which a corresponding one of the tab portions 26B are placed. A gear 85 is exposed from the left end of the connecting portion 82. The gear 85 is configured to receive a driving force from the main motor and engage with the gear 21B of the belt unit 20. A pair of registration mark sensors 90, which is an example of a mark sensor, is disposed on the left and right ends of the connecting portion 82 so as to face the conveyor belt 23. The registration mark sensors 90 are known sensors having a light emitting portion (not shown) that emits infrared light toward the conveyor belt 23 and a light receiving portion (not shown) that detects reflected light from the conveyor belt 23. The registration mark sensors 90 are configured to detect a registration mark for correcting a color shift when the registration mark is formed on the conveyor belt 23 by each image forming unit 30. It is appreciated that three or more registration mark sensors 90 may also be used.

When the belt unit 20 is attached to the image forming apparatus 1, the bearing members 26A engage in the grooves 83A, and the tab portions 26B contact the seat portions 83B, so that the belt unit 20 is placed in position within the belt unit supporting portion 80 as shown in FIG. 2. That is, the engagement between the bearing portions 26A and the grooves 83A determines the position of the belt unit 20 in the front-rear direction, and the contact between the tab portions 26B and the seat portions 83B determines the position of the belt unit 20 in the height direction.

Figure 5:
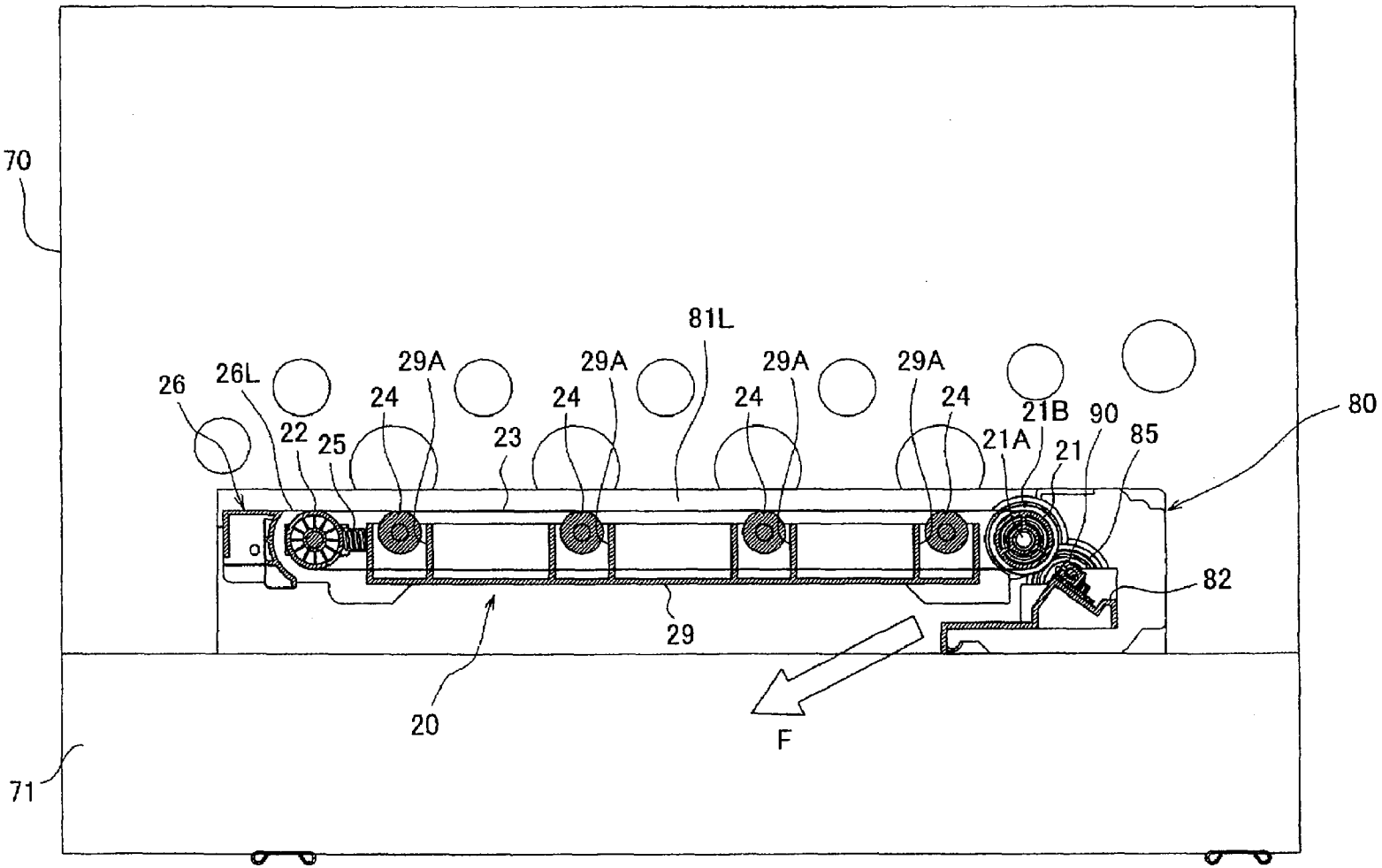
FIG. 5 is a sectional view along the line A-A of FIG. 2.

In addition, as shown in FIG. 5, the gear 85 of the belt unit supporting portion 80 engages with the gear 21B of the belt unit 20, which allows the conveyor belt 23 to rotate via the drive roller 21. At this time, the registration mark sensors 90 are opposite to the surface of the conveyor belt 23 that is curved along the surface of the drive roller 21. A bottom plate 29 connects the side portions 26L, 26R of the belt unit 20 at their lower ends. The bottom plate 29 is formed with four transfer roller receiving portions 29A in which the four transfer rollers 24 are received respectively.

In the image forming apparatus 1, the connecting portion 82 (that holds the registration mark sensors 90 for detecting a registration mark) and the side portions 81L, 81R (that position the belt unit 20 at a predetermined position in the apparatus body) are integrally formed of resin. This achieves preferable positional accuracy between the registration mark sensors 90 and the conveyor belt 23, and allows correct color registration. In addition, force F that is applied to the bearing member 26A (as shown in, for instance, FIG. 3) during transmission of the driving force by engagement between the gear 85 and the gear 21B includes a component in a direction shown by an arrow of FIG. 5, that moves the bearing member 26A toward the groove 83A. Thus, the force F aids in positioning the belt unit 20, allowing further preferable positional accuracy between the registration mark sensors 90 and the conveyor belt 23.

The grooves 83A receive the bearing members 26A that hold the rotation shaft 21A of the drive roller 21 in proximity to the registration mark sensors 90. The registration mark sensors 90 detect registration marks on the surface of the conveyor belt 23 that is curved along the surface of the drive roller 21, where the conveyor belt 23 is most reliably kept taut. As the registration mark sensors 90 are less sensitive to the qualities of the conveyor belt 23, such as expansion and contraction, fluttering, and wrinkles, they can detect the registration marks with high stability and reliability.

This illustrative embodiment shows, but is not limited to, that the belt unit 20 is positioned by engagement of the bearing members 26A with the grooves 83A. To position the belt unit 20, the rotation shaft 21A of the drive roller 21 may directly engage with the grooves 83A, and the shape of the grooves 83A may be altered. For example, the rotation shaft 21A may be pressed into the groove 83A or a groove of a different shape, e.g. a U-shaped groove, using a pressing force of an elastic member, e.g. a leaf spring. The positioning member of the embodiment may be configured to position a central portion of the belt unit 20 with respect to the front-rear direction or other portion of the belt unit 20.

Figure 6:
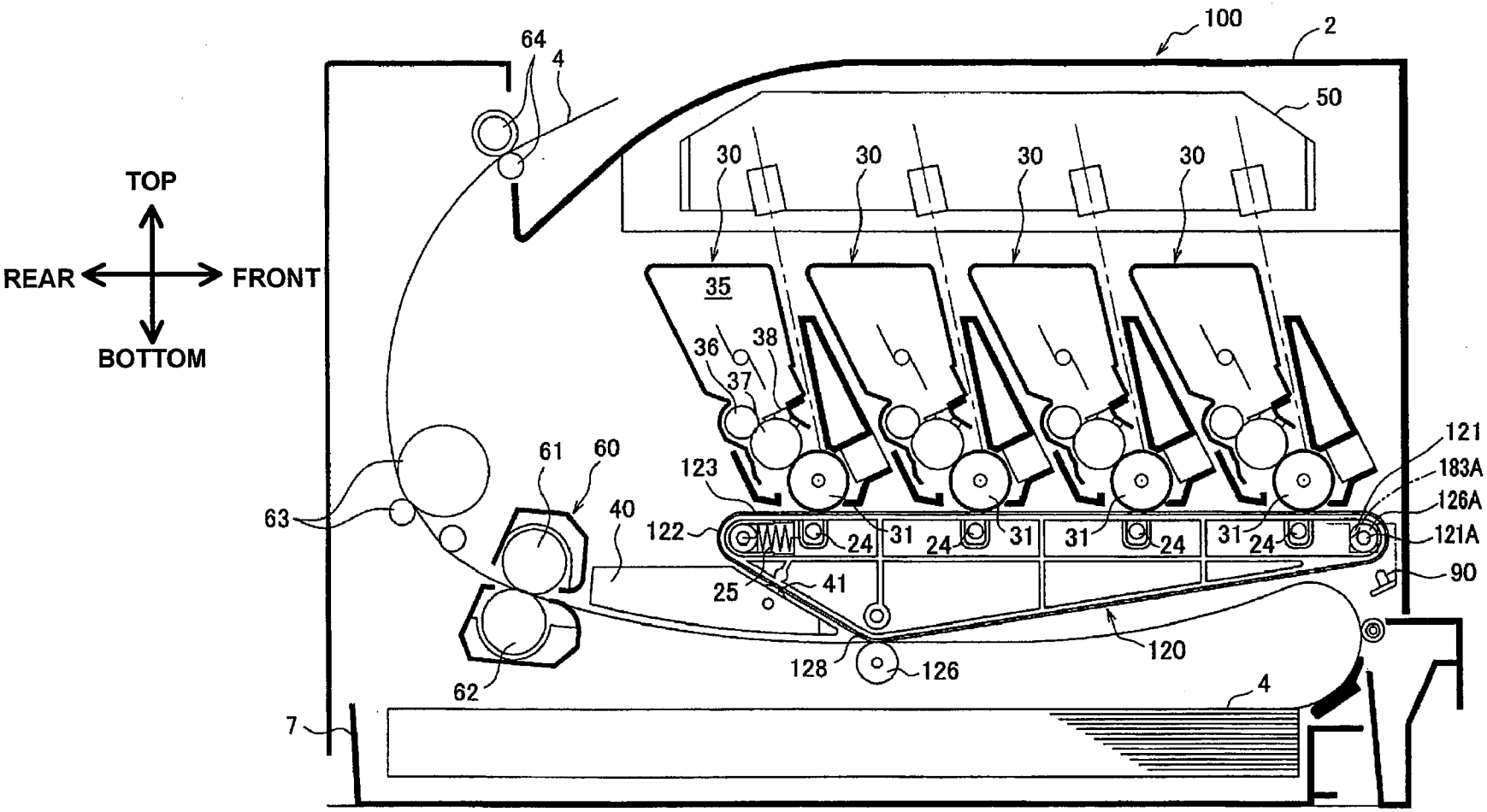
FIG. 6 is a side sectional view of an internal structure of another illustrative example of an image forming apparatus using features described herein.

The belt unit of one or more aspects may be a belt unit including an intermediate transfer belt. FIG. 6 is a side sectional view of an internal structure of an image forming apparatus 100 that is provided with such a belt unit including an intermediate transfer belt. It is noted that, in FIG. 6, elements similar to or identical with those shown in and described with reference to FIG. 1 are designated by similar numerals, and thus the description thereof can be omitted for the sake of brevity.

As shown in FIG. 6, the image forming units 30 and the scanner unit 50 are arranged in the reverse order with respect to the front-rear direction to how they are arranged in the image forming apparatus 1 shown in FIG. 1, that is, in the order of cyan, magenta, yellow, and black, from an upstream side with respect to the sheet feed direction or from the front side of the image forming apparatus 100. However, it is noted that the image forming apparatus 100 is similar to the image forming apparatus 1 regarding the internal structure of the image forming units 30 and the positional relationship between the photosensitive drums 31 and the corresponding transfer rollers 24. A belt unit 120 includes an intermediate transfer belt 123 that is extended between a drive roller 121, a tension roller 122, and a roller 128. While a recording sheet 4 passes between the intermediate transfer belt 123 disposed on the roller 128 and a second transfer roller 126, toner images, which are temporarily transferred from the photosensitive drums 31 to the intermediate transfer belt 123, are transferred onto the recording sheet. As the roller 128 is disposed below the drive roller 121 and the tension roller 122, the belt cleaner 40 is configured such that the cleaning roller 41 is brought into contact with the intermediate transfer belt 123 that is diagonally extended between the tension roller 122 and the roller 128.

In the image forming apparatus 100, registration marks are formed on the intermediate transfer belt 123. A bearing member 126A that receives a drive shaft 121A of the drive roller 121 is engaged in a groove 183A, and the registration mark sensors 90 are disposed on a member in which the groove 183A is formed. Thus, the registration mark sensors 90 are placed in position opposite to the drive roller 121, and the image forming apparatus 100 can also obtain effects similar to the image forming apparatus 1.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image formation device configured to form an image by transferring a plurality of colors of developers;

an apparatus body including the image formation device and a supporting member;

a belt unit configured to be attached to and removed from the apparatus body, the belt unit including:

a drive roller and a non-drive roller spaced apart from each other;

an endless belt extending around the drive roller and the non-drive roller, the endless belt being configured to face the image formation device and rotate in connection with an image formation operation of the image formation device when the belt unit is attached to the apparatus body; and a belt frame to which the drive roller and the non-drive roller are disposed; and a mark sensor configured to detect a registration mark on the endless belt, wherein the supporting member of the apparatus body includes:

a first positioning portion and a second positioning portion opposed to the first positioning portion, the first and second positioning portions being configured to support and position the belt unit at a predetermined position in the apparatus body; and a connection portion configured to support the mark sensor thereon and integrally formed with the first and second positioning portions such that the connection portion connects the first and second positioning portions.

2. The image forming apparatus according to claim 1, wherein the drive roller is configured to rotate the endless belt, and each of the first and second positioning portions includes a groove for receiving and positioning a shaft of the drive roller.

3. The image forming apparatus according to claim 2, further comprising:

a driving force transmission device configured to transmit a driving force from the apparatus body to the drive roller, wherein force applied to the shaft of the drive roller during transmission of the driving force includes a component in a direction in which the shaft of the drive roller moves toward the groove.

4. The image forming apparatus according to claim 1, wherein the mark sensor is disposed opposite to the drive roller via the endless belt, and is configured to detect the registration mark on a portion of the endless belt that is curved along the drive roller.

5. The image forming apparatus according to claim 1, wherein the supporting member includes a resin.

6. The image forming apparatus according to claim 2, wherein the mark sensor is disposed below the shaft of the drive roller.

7. The image forming apparatus according to claims 1, wherein the first positioning portion of the supporting member includes a first seat portion and the second positioning portion of the supporting member includes a second seat portion, wherein the belt frame of the belt unit includes a first tab portion and a second tab portion, and wherein the first and second tab portions of the belt frame are configured to contact the first and second seat portions of the supporting member when the belt unit is attached to the apparatus body.

8. The image forming apparatus according to claim 7, wherein the first and second tab portions are flush with a surface of the endless belt.

9. The image forming apparatus according to claim 7, wherein the driving force urges the shaft of the drive roller disposed to the belt frame into a position.

10. The image forming apparatus according to claim 7, wherein the first and second tab portions of the belt frame are disposed closer to the non-driven roller than the drive roller.

* * * * *